US007703883B2

(12) United States Patent
Tanaka et al.

(10) Patent No.: US 7,703,883 B2
(45) Date of Patent: Apr. 27, 2010

(54) INK JET RECORDING APPARATUS

(75) Inventors: Hiroyuki Tanaka, Kawasaki (JP); Takashi Nojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 601 days.

(21) Appl. No.: 11/402,948

(22) Filed: Apr. 13, 2006

(65) Prior Publication Data

US 2006/0256156 A1 Nov. 16, 2006

(30) Foreign Application Priority Data

May 12, 2005 (JP) ..... 2005-139418

(51) Int. Cl.
*B41J 23/00* (2006.01)
*B41J 2/165* (2006.01)

(52) U.S. Cl. ..... 347/37; 347/29

(58) Field of Classification Search ..... 347/37, 347/22, 29, 85–86; 357/29, 86, 37
See application file for complete search history.

(56) References Cited

U.S. PATENT DOCUMENTS 5,231,416 A 7/1993 Terasawa et al.
6,315,468 B2 * 11/2001 Kishida et al. ..... 400/55
6,913,340 B2 7/2005 Tanaka et al.
2002/0126177 A1 * 9/2002 Sugimura et al. ..... 347/29

FOREIGN PATENT DOCUMENTS

JP 9-109379 4/1997
JP 10-278396 10/1998

* cited by examiner

*Primary Examiner*—Julian D Huffman
*Assistant Examiner*—Jason S Uhlenhake
(74) *Attorney, Agent, or Firm*—Fitzpatrick, Cella, Harper & Scinto

(57) ABSTRACT

An ink jet recording apparatus includes a carriage for mounting therein a recording head which executes a recording operation by discharging ink onto a recording material, a conveying roller for conveying a recording material, and a cap for covering a discharge port of the recording head. In addition, a pump generates a negative pressure in an interior of the cap, a lock member, adapted to be rotated in synchronism with the rotation of the conveying roller, locks movement of the carriage, and a drive transmission mechanism transmits a driving power of the conveying roller to the pump. The drive transmitting mechanism is equipped with a delay mechanism for delaying transmission of the driving power to the pump until the conveying roller has been rotated by an amount corresponding to an amount of rotation of the lock member for shifting the carriage from a locked state to an unlocked state.

11 Claims, 17 Drawing Sheets

INK JET RECORDING APPARATUS

BACKGROUND OF THE INVENTION

1. Field of the Invention

The present invention relates to an ink jet recording apparatus provided with locking means for fixing a recording head at a capping position.

2. Related Background Art

An ink jet recording apparatus for executing a recording operation by discharging ink from a recording head onto a recording material is known to be provided with a recovery mechanism including capping means, wiping means, suction recovery means or the like, for recovering and maintaining an ink discharge performance of the recording head. Particularly in an ink jet recording apparatus utilizing a recording head mounted on a carriage which reciprocates in a main scanning direction, it is known to utilize, at a predetermined position outside a recording area, a recovery mechanism which includes a slider following the movement of the carriage and moving along a cam surface, and which executes a capping operation by contacting a cap, mounted on the slider, with the recording head. Such recovery mechanism is described for example in U.S. Pat. No. 6,913,340.

There is also known an ink jet recording apparatus including a carriage lock mechanism, which stops (locks) the carriage in a capping position in a continuously stable state, in a state where the recording head is capped with the cap member. Such ink jet recording apparatus is described for example in Japanese Patent Application Laid-open Nos. H09-109379 and H10-278396.

There is also proposed an ink jet recording apparatus in which, in order to stabilize the position of the carriage when it is in the capping position, a lateral face of the carriage is restricted by a locking lever activated by a conveying roller, whereby the carriage is inhibited from leaving the capping state and moving toward the recording area. In such structure, even when an impact is applied externally to the apparatus, the carriage can constantly maintain the capped state, whereby even when the recording apparatus is not used for a prolonged period, a discharge port of the recording head can be protected from ink solidification and can maintain a stable performance.

Also a recovery mechanism described in U.S. Pat. No. 6,913,340 is combined with the above-described carriage locking mechanism and is so constructed that, after a negative pressure is generated by a pump in the cap while the recording head is capped to execute a suction recovery and before the carriage lock is released, the carriage is further advanced deeper in the recovery mechanism then the cap is separated from the recording head to expose the discharge port to the atmosphere, and the conveying roller is driven in the reverse direction. Such structure allows to provide an ink jet recording apparatus capable of realizing a locking function for the carriage and a recovery function by the ink suction, by a simple structure.

Also Japanese Patent Application Laid-open No. H09-109379 discloses such a structure that when the carriage is in a fixed position such as the capping position, a relative position between the cap and the carriage is fixed by a lock pin which engages with the carriage and a cap holder supporting the cap.

However, these prior technologies described above involve following technical issues. The technology disclosed in Japanese Patent Application Laid-open No. H09-109379 is capable of reducing a lateral dimension of the main body of the apparatus, but requires a complex constitution for vertically moving the lock pin, thus increasing the number of components and resulting in an increased cost. Also though the lock pin itself can be driven by the driving power of the conveying roller, the pump and other operating parts require a drive source separate from that for the conveying roller, thereby resulting in an increased cost.

In the technology disclosed in Japanese Patent Application Laid-open No. H10-278396, after the pump is activated in the capped state of the recording head to generate a negative pressure in the cap for executing the suction recovery operation, it is necessary, in retracting the carriage from the recovery mechanism, to rotate the conveying roller in the forward direction for releasing the locking member. As the forward rotation of the conveying roller causes the pump to release the negative pressure, it is not possible to separate the cap from the recording head while maintaining the negative pressure. Therefore, when the cap is separated, the sucked ink may remain in a large amount on a discharge port-bearing face of the recording head. Such residual ink of large amount may result in various problems such as an incomplete ink wiping in a subsequent wiping operation, an ink overflowing into the apparatus, and an ink color mixing in a recording operation after the suction recovery.

In the technology of U.S. Pat. No. 6,913,340, the carriage can be released from the locked state after the suction recovery operation of the recording head, but it is necessary to release the cap while maintaining a negative pressure within the cap, in order to reduce the ink amount remaining on the discharge port-bearing face of the recording head. However a reverse rotation of the conveying roller for executing a suction operation, in order to separate the cap while maintaining the negative pressure within the cap, also operates the locking member, whereby the carriage cannot be moved from the capping position toward the recording area. Thus, there is required an area to allow the carriage to move to a further advanced position from the capping position, whereby the lateral width of the apparatus becomes inevitably larger.

Also in such further advanced position of the carriage from the capping position, the cap naturally becomes open. Therefore, despite of the carriage lock mechanism, a cap opening force is applied in such a direction as to advance the carriage toward the recovery mechanism. Thus, despite of the carriage lock mechanism, the recording head may not be securely capped.

SUMMARY OF THE INVENTION

An object of the present invention is to provide an ink jet recording apparatus capable, even in the presence of a carriage lock mechanism, of separating a cap from a recording while maintaining a negative pressure within the cap, thereby reducing an ink amount remaining on a discharge port face or in the cap after an ink suction operation.

Another object of the present invention is to provide an ink jet recording apparatus including a carriage for mounting therein a recording head which executes a recording operation by discharging ink onto a recording material and for executing a reciprocating motion, a conveying roller for conveying the recording material in a direction crossing the moving direction of the carriage, a cap for covering a discharge port of the recording head, a pump for generating a suction force in the interior of the cap, and a drive transmission mechanism for transmitting a driving power of the conveying roller to the pump, wherein the drive transmission mechanism drives the pump with a certain delay in time from a forward/reverse rotation switching of the conveying roller.

DETAILED DESCRIPTION OF THE PREFERRED EMBODIMENTS

Figure 1:
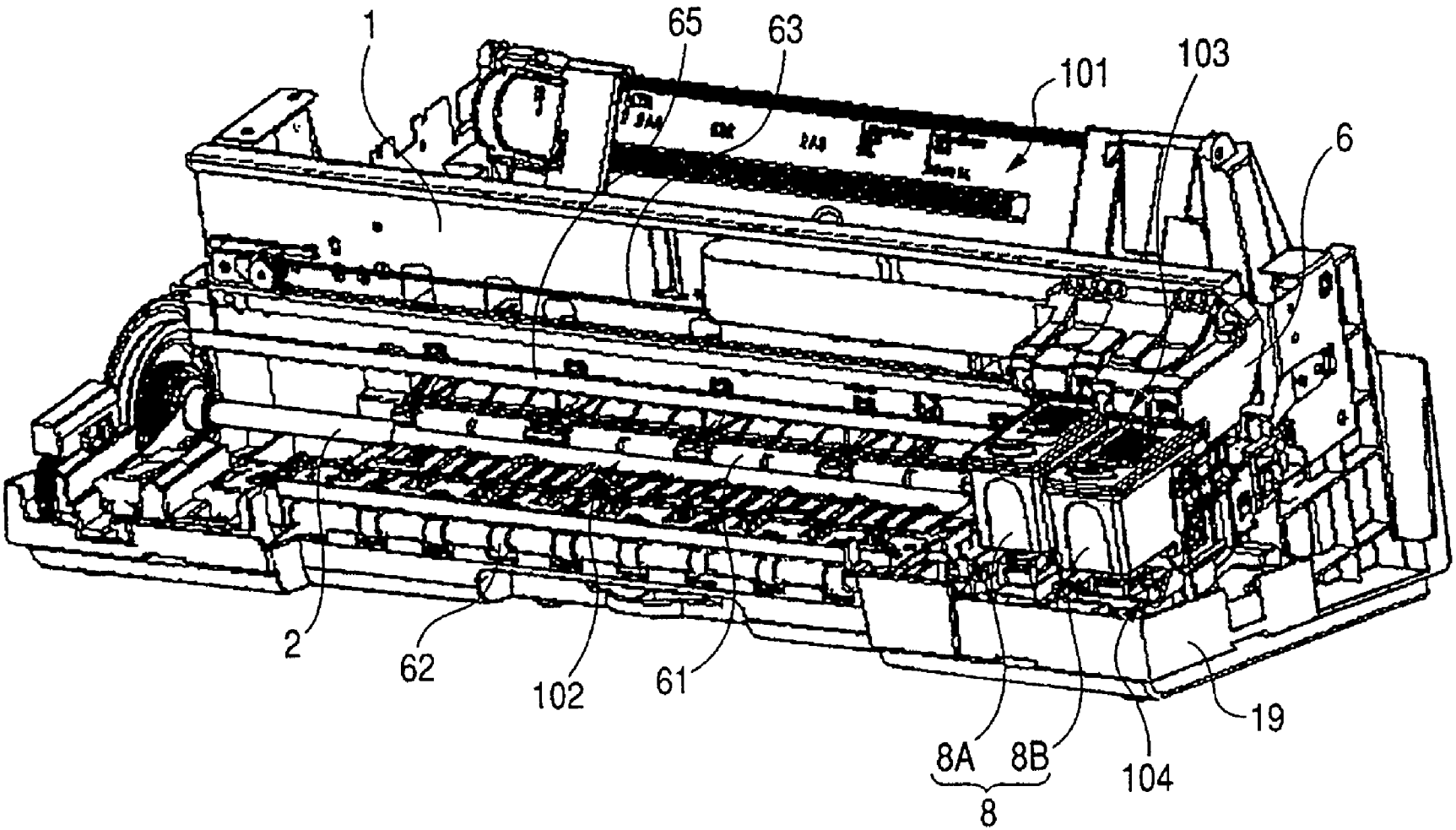
FIG. 1 is a perspective view showing an embodiment of an ink jet recording apparatus embodying the present invention.

In the following, embodiments of the present invention will be explained with reference to the accompanying drawings. Throughout the drawings, a same symbol indicates a same or equivalent part. Also in case plural components or parts are indicated by numbers with suffixes, all such components or parts or an arbitrary one thereof will be indicated by a number without a suffix. FIG. 1 is a perspective view of an embodiment of an ink jet recording apparatus embodying the present invention, wherein the ink jet recording apparatus includes a sheet supply portion 101, a conveying portion 102, a recording mechanism (scanning unit) 103, and a recovery mechanism (cleaning mechanism) 104. The sheet supply portion 101 supplies a recording material, such as a recording paper, into the main body of the apparatus. The conveying portion conveys the recording material through the main body of the apparatus. The recording mechanism records an image, based on image information, on the recording material. The recovery mechanism serves to maintain and recover an ink discharge performance of the recording head, in order to maintain a quality of the image to be recorded.

The recording material, stacked in the sheet supply portion 101, is separated and advanced one by one by a sheet feed roller driven by a sheet feed motor, and is fed to the conveying portion 102. The recording material supplied to the conveying portion 102 is conveyed, by a conveying roller 2 driven by a conveying motor and by a pinch roller 61, through the recording portion. In the recording portion, a recording mechanism 103 executes a recording on the recording material. The recording is executed by driving a recording head 8, supported by a carriage 6 moving in a main scanning direction, according to image information thereby discharging ink from discharge ports of the recording head. The recording material after recording is discharged, by a sheet discharge roller 62 driven in synchronization with the conveying roller 2 and by a spur pressed thereto, to the exterior of the apparatus. In FIG. 1, 1 indicates a chassis supporting various functional components, and 19 indicates a base portion of the main body of the apparatus.

The recording mechanism 103 is equipped with a carriage 6, so supported and guided as to be capable of reciprocating motion in the main scanning direction, and recording cartridges 8A, 8B mounted on the carriage. The carriage 6 is so supported and guided as to be capable of reciprocating motion along a guide shaft and a guide rail provided in the main body of the apparatus, and is reciprocated by a carriage motor through a carriage belt 63. The displacement of the recording mechanism 103 is controlled by detecting a position and a speed thereof, by means of an encoder sensor mounted on the carriage 6 and an encoder scale 65, provided in the main body of the apparatus. The recording is executed on the entire recording material, by repeating a recording operation of the recording head 8 executed in synchronization of the movement (main scanning) of the carriage 6, and a conveying operation (sub scanning) of the recording material by a predetermined pitch.

Figure 2:
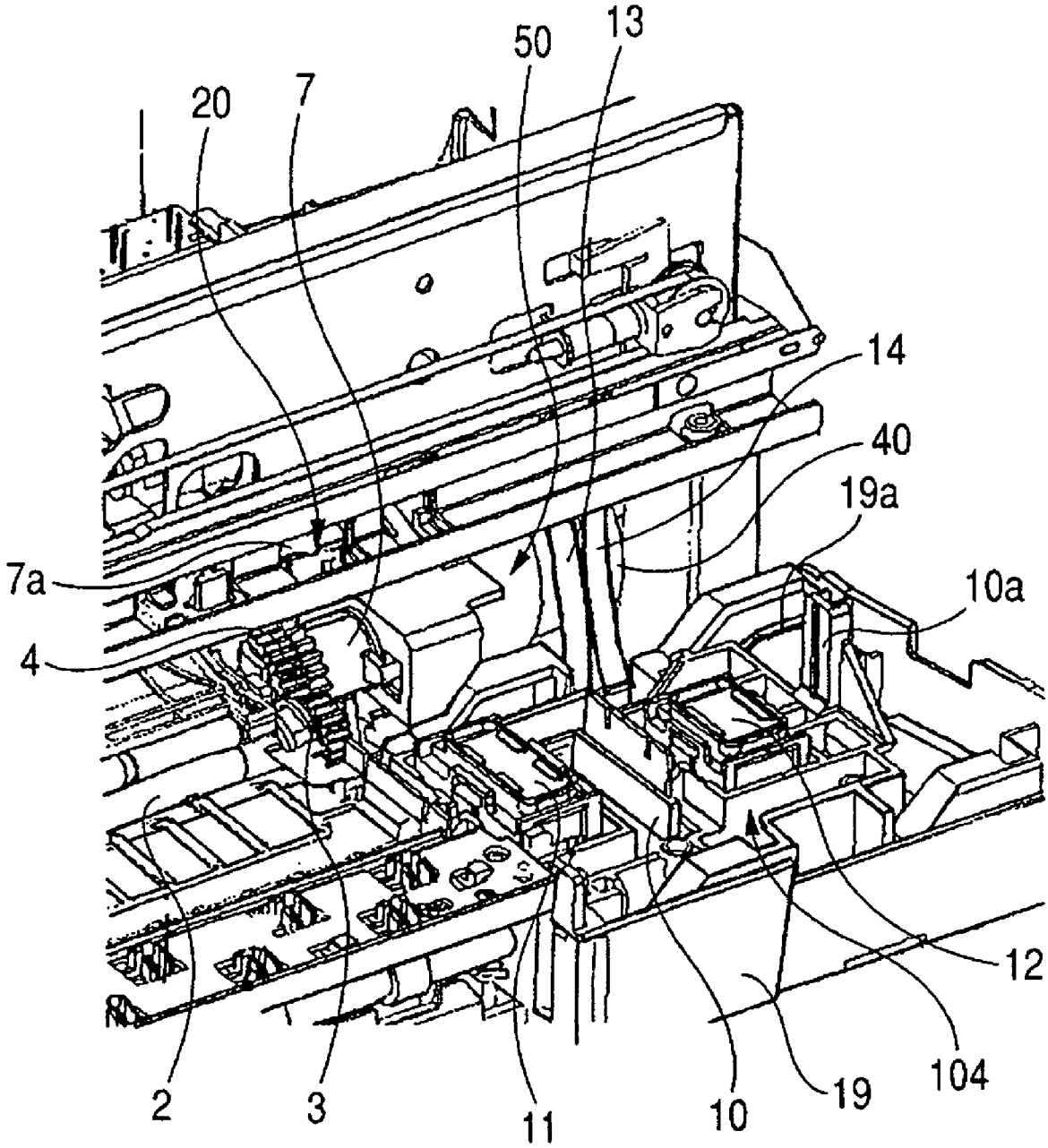
FIG. 2 is a perspective view showing, in the ink jet recording apparatus shown in FIG. 1, a state in which a recording mechanism is not positioned in a recovery mechanism.
Figure 3:
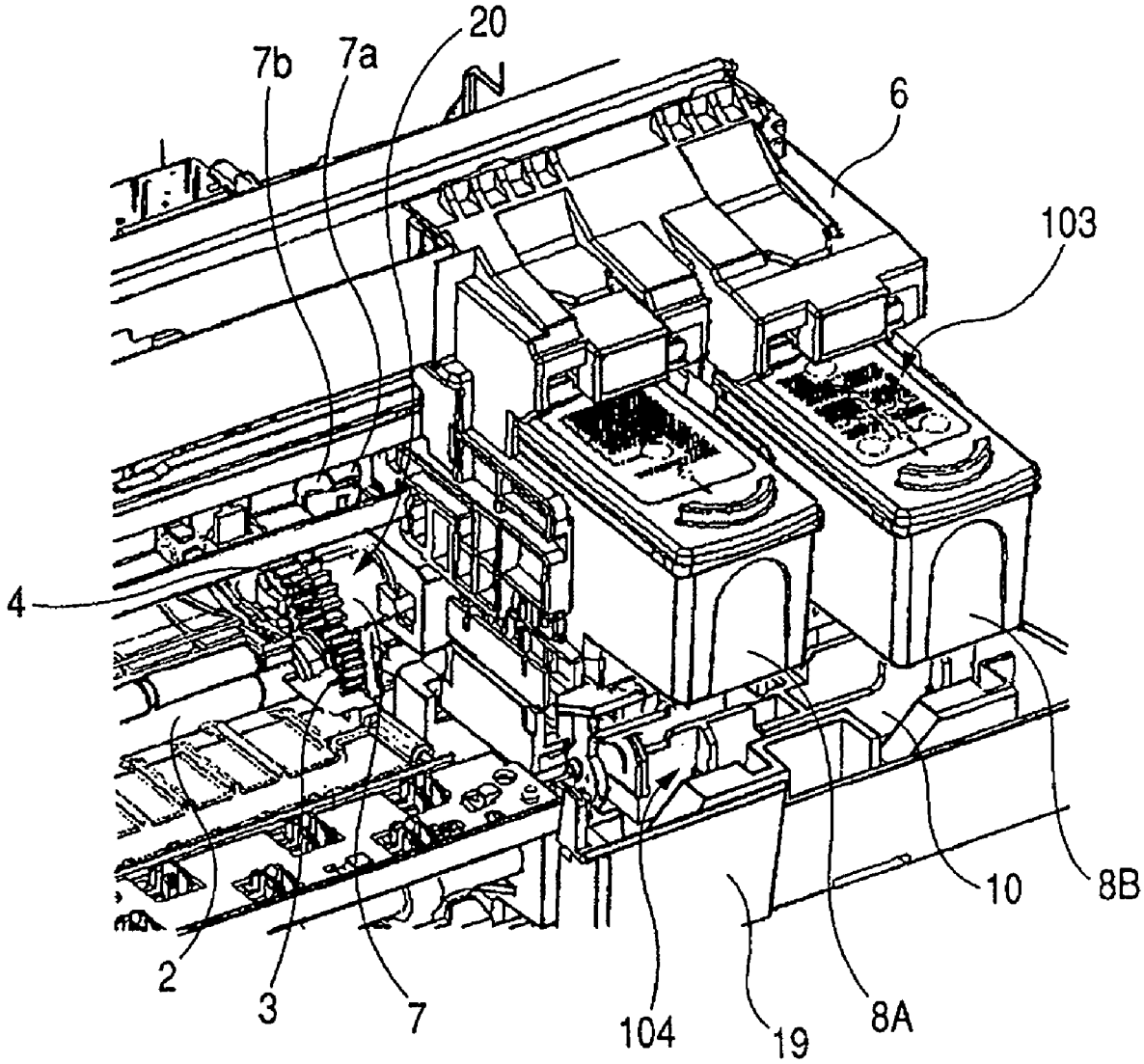
FIG. 3 is a perspective view showing a state in which the recording mechanism is in a capping position of the recovery mechanism and lock means is retracted.
Figure 4:
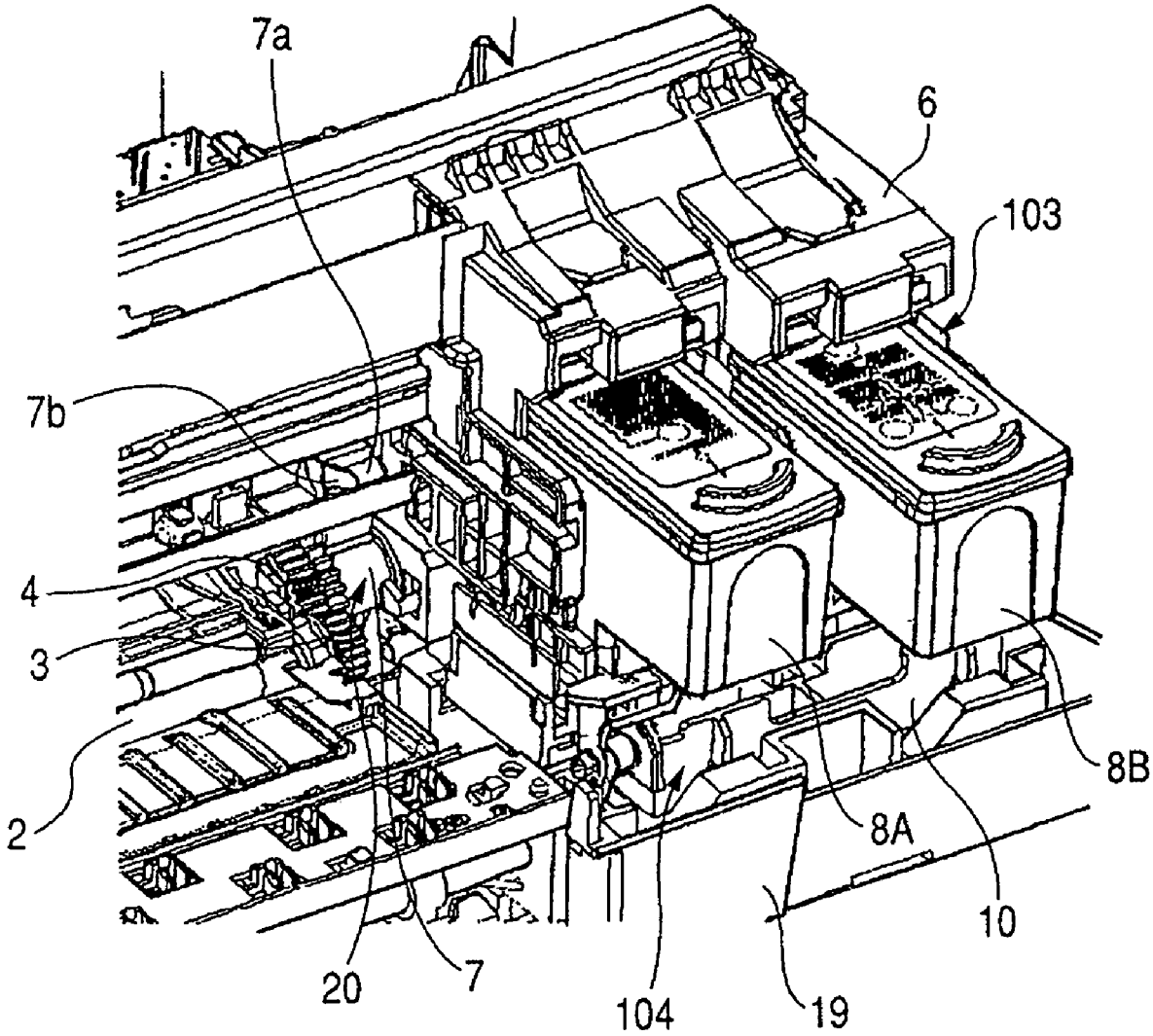
FIG. 4 is a perspective view showing a state in which the recording mechanism is in a capping position of the recovery mechanism and lock means is engaged.
Figure 5:
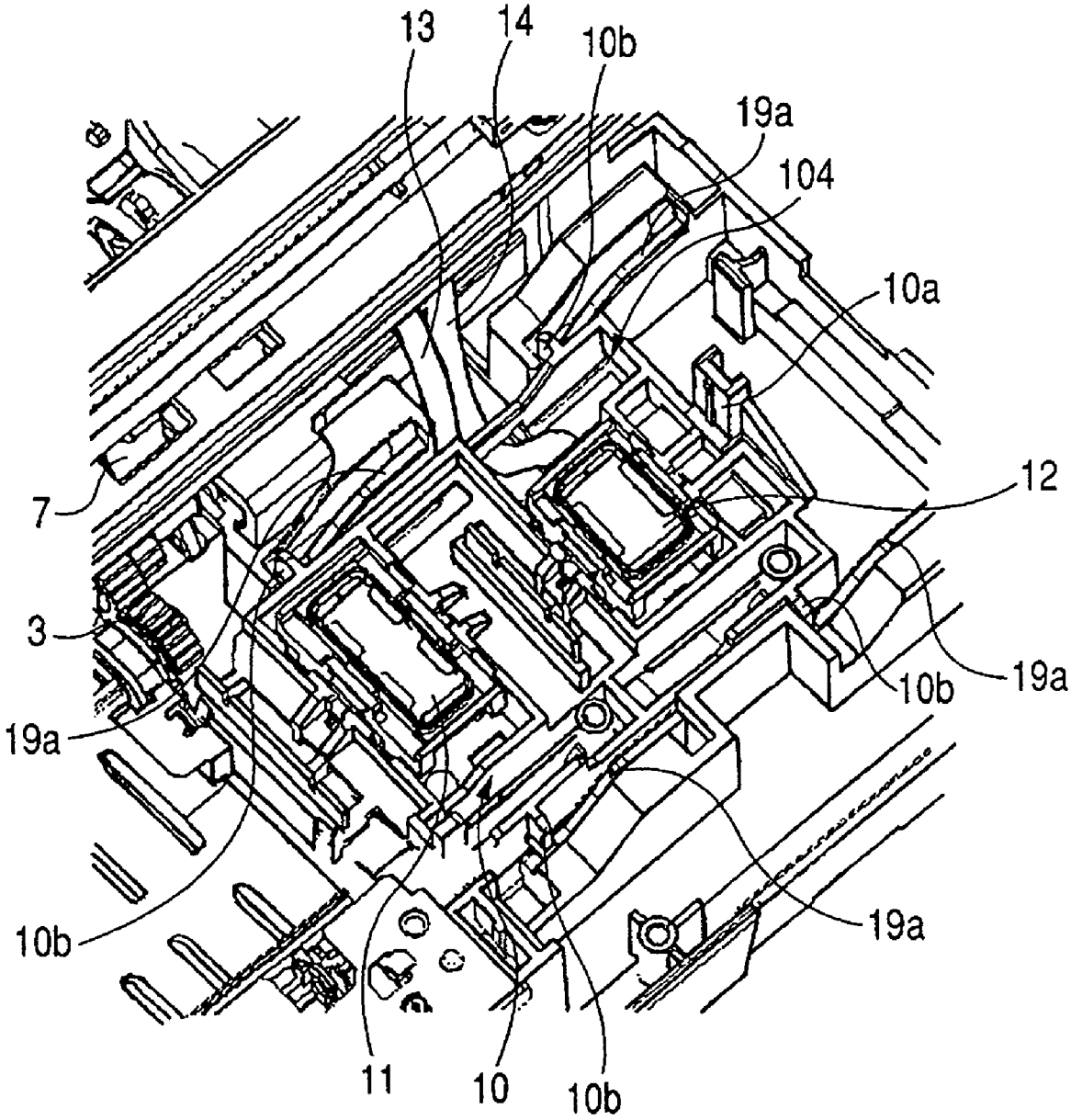
FIG. 5 is a perspective view, seen from obliquely above, of the recovery mechanism of the ink jet recording apparatus shown in FIG. 1.

FIG. 2 is a perspective view showing in the ink jet recording apparatus shown in FIG. 1, a state in which the recording mechanism 103 is not positioned in the recovery mechanism 103; FIG. 3 is a perspective view showing a state in which the recording mechanism is in a capping position of the recovery mechanism and lock means 7 is retracted; FIG. 4 is a perspective view showing a state in which the recording mechanism is in a capping position of the recovery mechanism and lock means is engaged; and FIG. 5 is a perspective view, seen from obliquely above, of the recovery mechanism of the ink jet recording apparatus shown in FIG. 1.

The recovery mechanism 104 serves to solve a clogging or the like of the discharge port of the recording head 8, thereby recovering and maintaining a proper quality of the recorded image. The recovery mechanism includes, for example, capping means which covers the discharge port of the recording head, a pump constituting a negative pressure suction means which sucks ink from the discharge port and the cap, and wiping means which wipes the discharge port-bearing face of the recording head. The recovery mechanism 104 of the present embodiment is provided, as shown in FIGS. 2 and 5, with a slider 10 capable of moving over a predetermined range together with the carriage when the recording mechanism 103 moves (enters) the area of the recovery mechanism. Two caps 11, 12 constituting the capping means are mounted on the slider 10, and the two caps 11, 12 respectively correspond to the two recording heads 8A, 8B mounted on the carriage. These two recording heads are constituted, for example, of a head for recording with ink of plural colors and a head for recording with a single color such as black, and the discharge port face has an array of discharge ports in a number corresponding to the number of ink colors.

Referring to FIGS. 2 to 5, the slider 10 is so mounted, when the recording mechanism 103 proceeds to the recovery mechanism 104, can move, following the recording mechanism 103 over a predetermined range. The slider 10 is provided, in two positions on each side (four positions in total), with laterally extended projections 10*b*, which respectively contact cam faces of slider cams 19*a* (FIG. 5) provided in four positions of the base portion 19 of the main body. Also the slider 10 is urged obliquely downwards by a tension spring (slider spring) provided between the slider 10 and the base portion 19, whereby the projections 10*b* are respectively in a pressed contact with the upper faces (cam faces) of the respectively corresponding slider cams 19*a*.

When the recording mechanism 103 enters the recovery mechanism 104, a lateral face of the carriage 6 contacts an impingement portion 10*a* of the slider 10. Then, when the carriage further moves in the proceeding direction, the slider 10 follows the carriage and is gradually elevated by moving along the slider cams 19*a*. Upon moving to a capping position corresponding to the uppermost portions of the slider cams, the caps 11, 12 contact closely the discharge port faces of the recording heads 8A, 8B, thereby realizing a capped state. The slider cam 19*a* has a retracted position (stand-by position) at which the slider 10 assumes a lowermost position for example when not in contact with the carriage. Also, between the capping position and the retracted position, there is provided a wiping position for wiping the discharge port face with a wiper provided on the slider 10.

When the carriage 6, after proceeding to the deepest position in the recovery mechanism 104, changes the moving direction and moves toward the recording area, the slider 10 gradually descends together with the carriage 6. Then, after a movement over a predetermined distance, the slider 10 is separated from the carriage 6 and returned to the initial stand-by position. The caps 11, 12 are connected to tubes 13, 14 of which the other ends are connected to a pump (suction pump or tube pump) 50 constituting negative pressure generating means. The pump 50 is provided, as shown in FIG. 2, at an upstream side, in the conveying direction, of the recovery mechanism in the main body of the apparatus.

Figure 6:
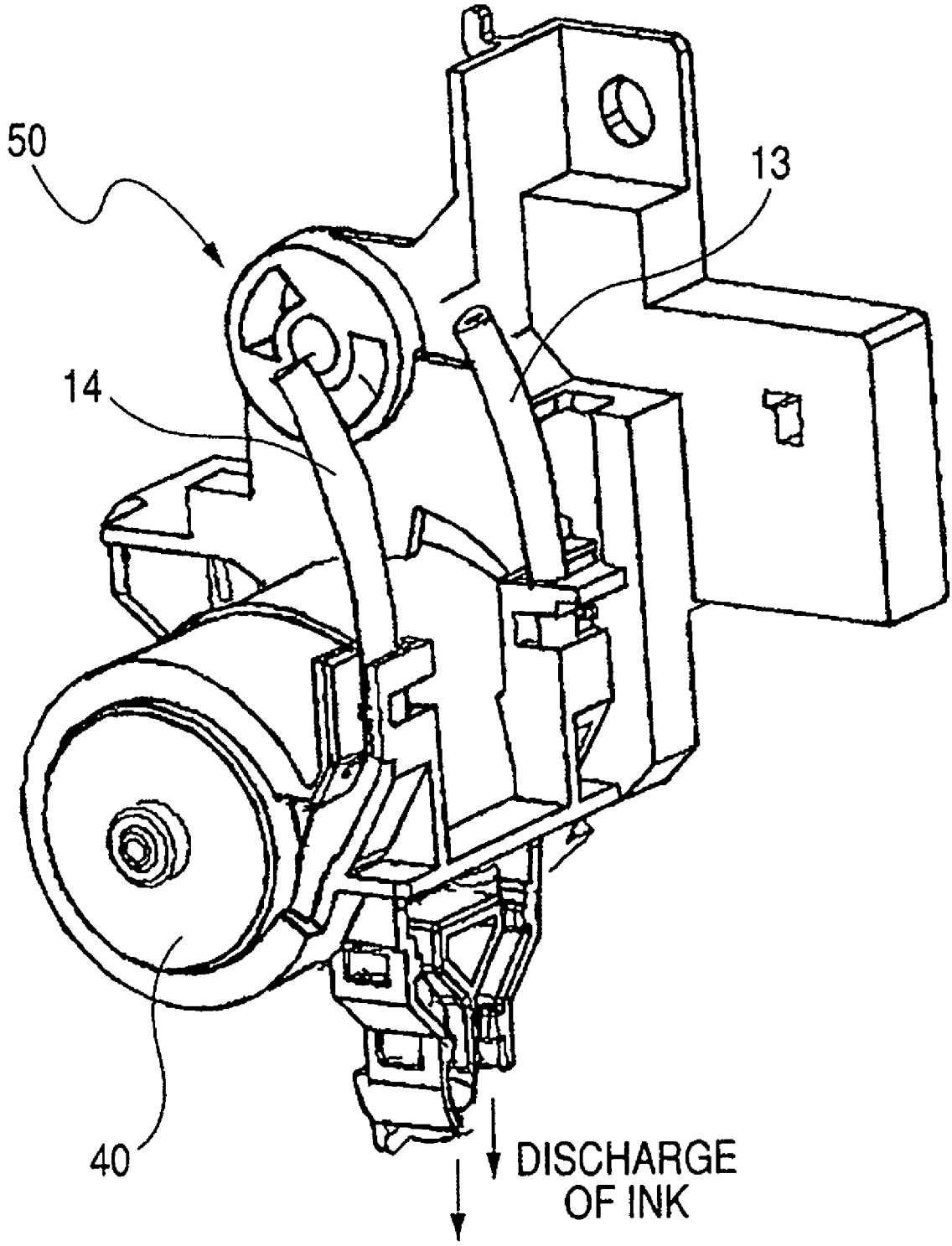
FIG. 6 is an external perspective view, seen from behind, of a pump connected to a cap of the recovery mechanism.
Figure 7:
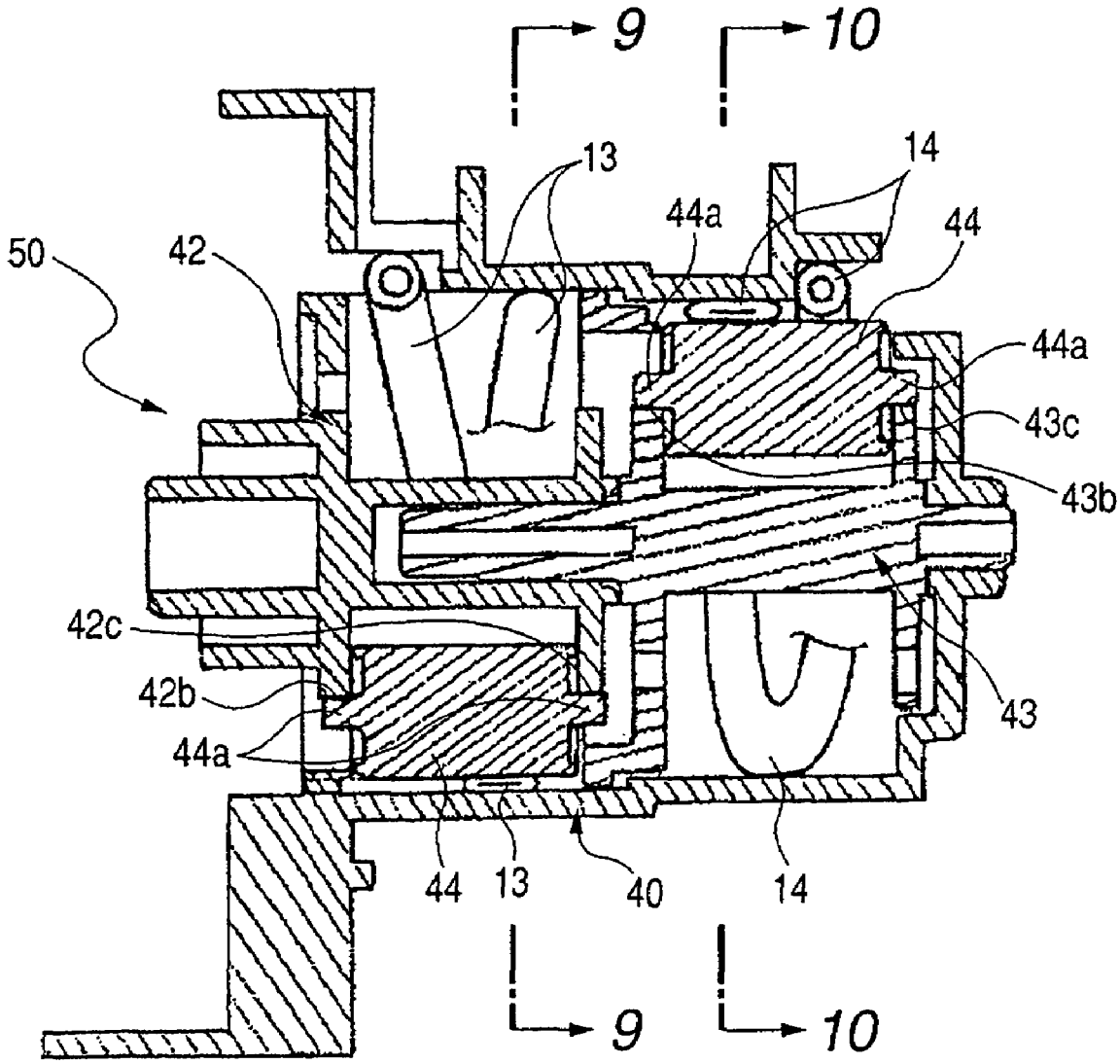
FIG. 7 is a vertical cross-sectional view at the center of the pump shown in FIG. 6.
Figure 8:
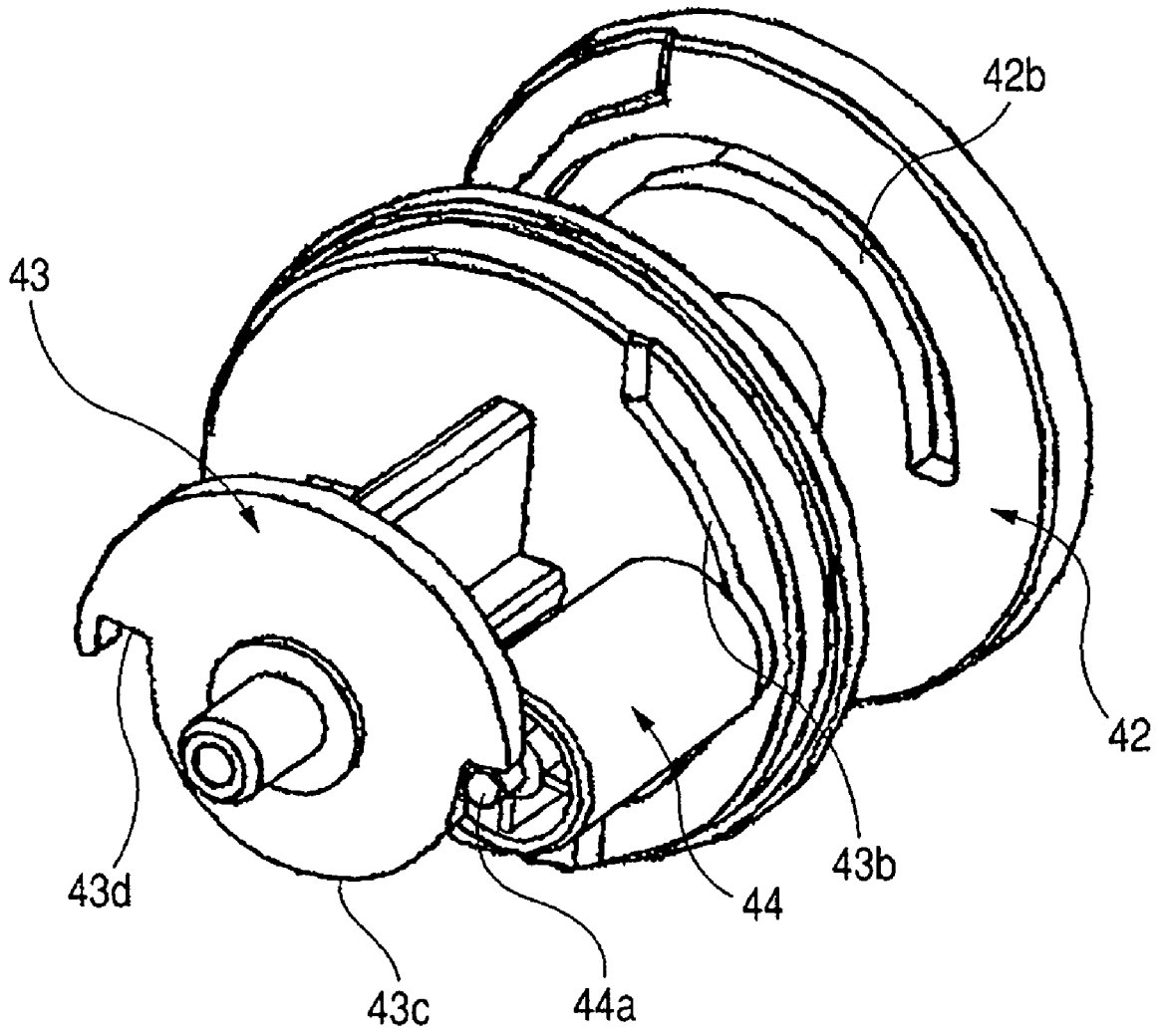
FIG. 8 is a perspective view showing an assembly (holder unit) of two roller holders in FIG. 7.
Figure 9:
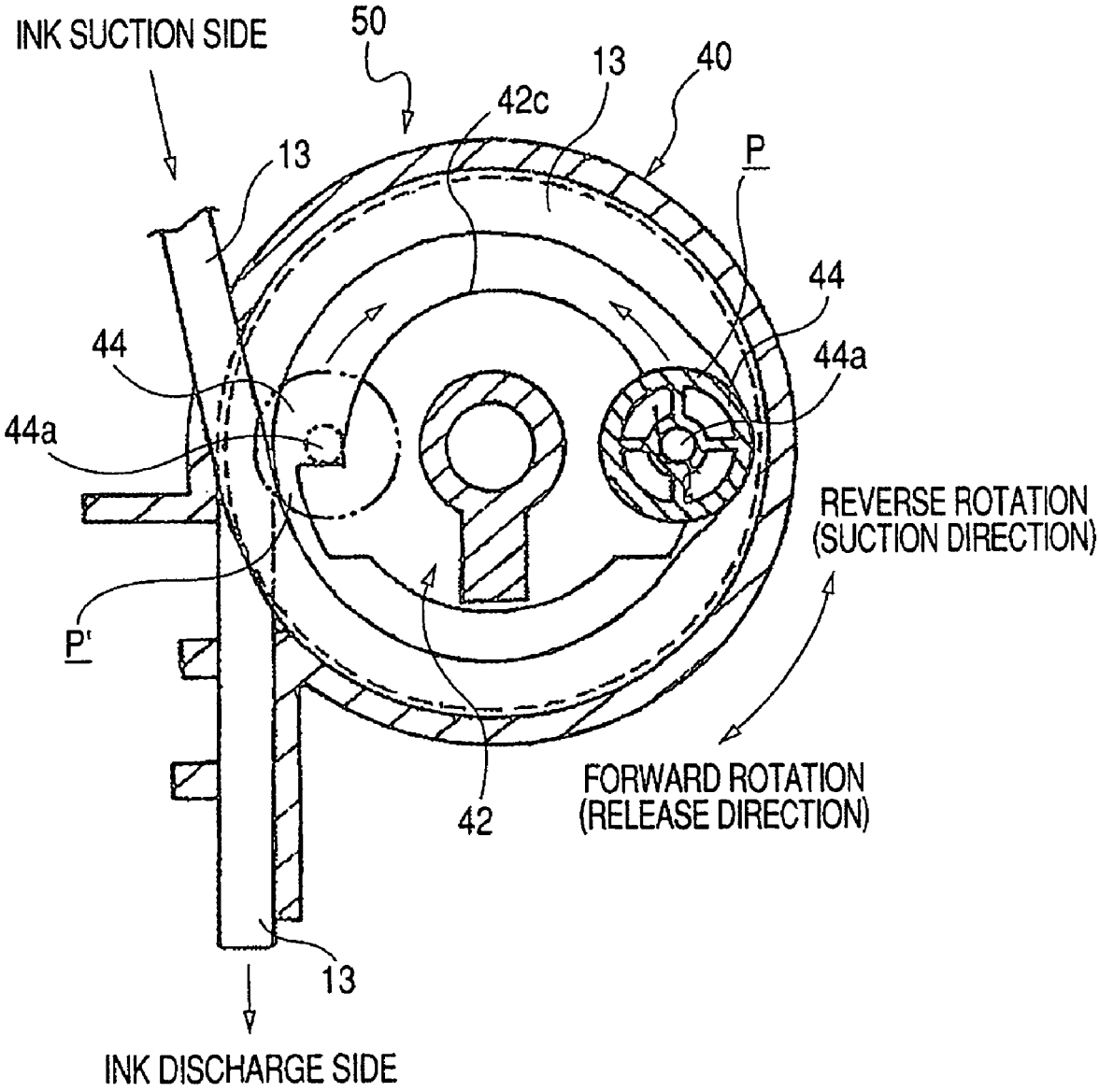
FIG. 9 is a horizontal cross-sectional view of the pump along a line 9-9 in FIG. 7.
Figure 10:
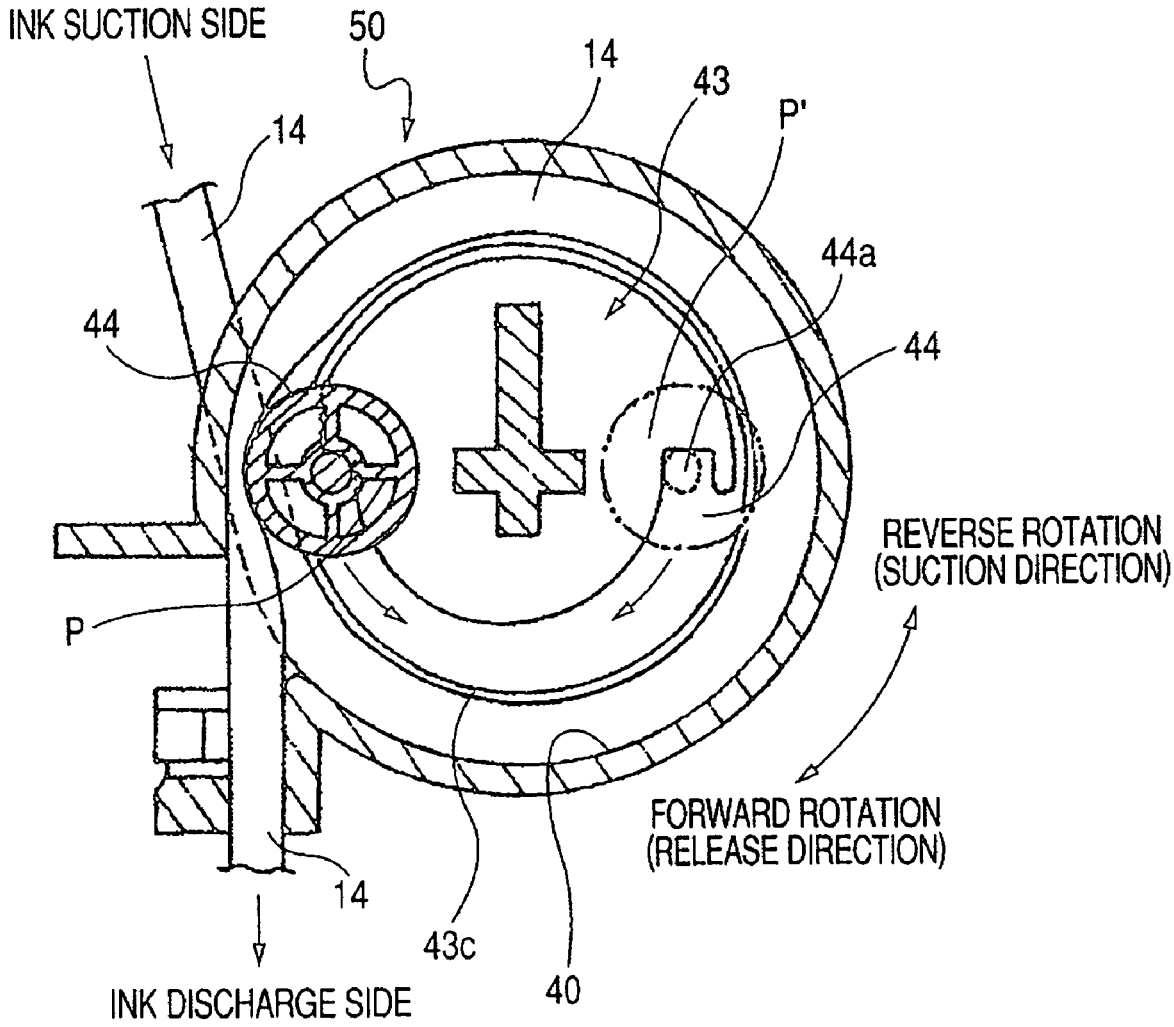
FIG. 10 is a horizontal cross-sectional view of the pump along a line 10-10 in FIG. 7.

FIG. 6 is an external perspective view, seen from behind, of the pump 50 connected to a cap of the recovery mechanism; FIG. 7 is a vertical cross-sectional view at the center of the pump shown in FIG. 6; FIG. 8 is a perspective view showing an assembly (holder unit) of two roller holders in FIG. 7; FIG. 9 is a horizontal cross-sectional view along a line 9-9 in FIG. 7; and FIG. 10 is a horizontal cross-sectional view along a line 10-10 in FIG. 7. As shown in FIGS. 6 to 10, the pump 50 squeezes the tubes 13, 14 communicating with the caps 11, 12 through rollers 44 to generate a negative pressure in these tubes, and to apply such negative pressure to the discharge ports. Therefore, the pump 50, activated in the capped state of the recording heads 8A, 8B, allows to suck the ink from the discharge ports thereof, and, activated in the opened state of the caps, allows to remove the ink stored within the cap.

As shown in FIGS. 7 to 10, the pump 50 is so constructed that roller holders 42, 43 mounted inside a pump base 40 are driven in rotation thereby squeezing the tubes 13, 14 with the rollers 44 supported by such roller holders. Each of the tubes 13, 14 is positioned along the internal wall of the pump base 40, over a length of one turn. The two roller holders 42, 43 are integrally driven in rotation. One roller 44 each is rotatably supported on each of the roller holders 42, 43 with a predetermined phase relationship (with a phase of 180° in the illustrated example). Thus, there is constructed a two-unit pump in which the roller holders 42, 43, when rotated counterclockwise in FIGS. 9 and 10, squeezes the two tubes 13, 14 with the rollers 44 thereby generating a negative pressure in each tube.

Referring to FIGS. 9 and 10, when the roller holders rotate counterclockwise, the axis of each roller 44 is held (locked) in a radially outward position as indicated by a solid line to assume an on-state, for squeezing each tube and thus generating a negative pressure. On the other hand, when the roller holders rotate clockwise, the axis of each roller 44 is supported in a radially inward position as indicated by a chain line to assume an off-state, in which each tube is released and the interior thereof communicate with the atmosphere. Two rollers 44 are employed in the present embodiment in order to introduce negative pressures through the tubes 13, 14 to the two caps 11, 12 respectively corresponding to the two recording heads 8A, 8B. In case of employing a single recording head with a single corresponding cap, there can be employed a single-unit pump having only one roller. In FIGS. 9 and 10, P indicates a roller position at the negative pressure generation, and P' indicates a roller position in case of releasing the negative pressure.

Referring to FIGS. 7 to 10, the roller holder 42 is provided with sliding faces 42*b*, 42*c* on which both end shafts of the roller 44 move under rotation, and the roller holder 43 is similarly provided with sliding faces 43*b*, 43*c* on which both end shafts of the roller 44 move under rotation. Ink suction by a negative pressure generation is achieved by rotating the roller holders 42, 43 counterclockwise as shown in FIGS. 9 and 10 (corresponding to a reverse rotation of the conveying roller to be explained later) to a charged state where the rollers 44 have traveled on the sliding faces to completely compressed the tubes 13, 14, and by further rotating the roller holders. Also release of the negative pressure can be achieved by rotating the roller holders in an opposite direction (corresponding to a forward rotation of the conveying roller to be explained later), thereby relieving the tubes 13, 14 from the compressed state by the rollers 44 and causing the interior of the tubes to communicate with the atmosphere.

Figure 11:
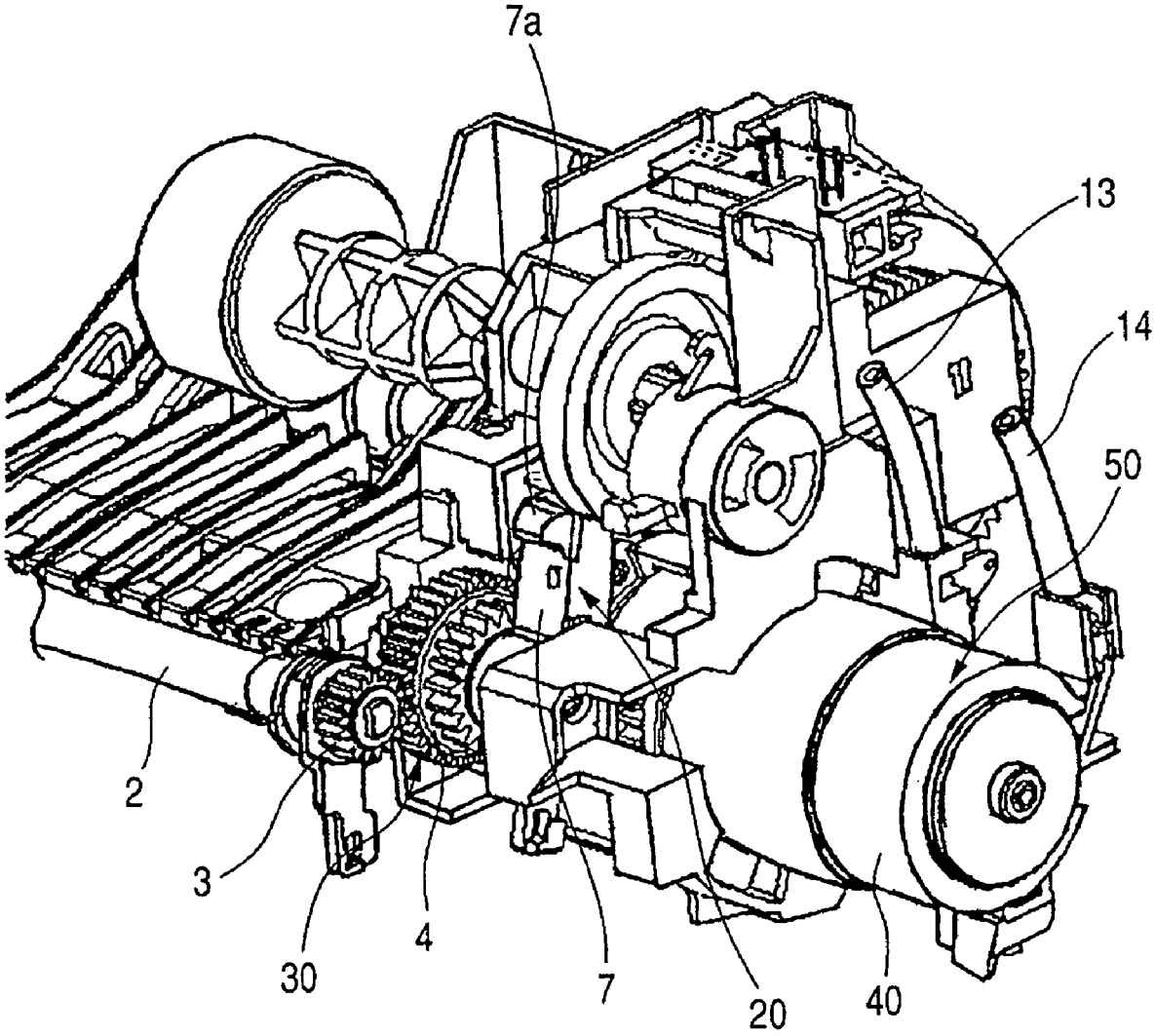
FIG. 11 is a partial perspective view of a drive transmission mechanism for driving an ink suction pump, shown together with the pump, in the ink jet recording apparatus embodying the present invention.
Figure 12:
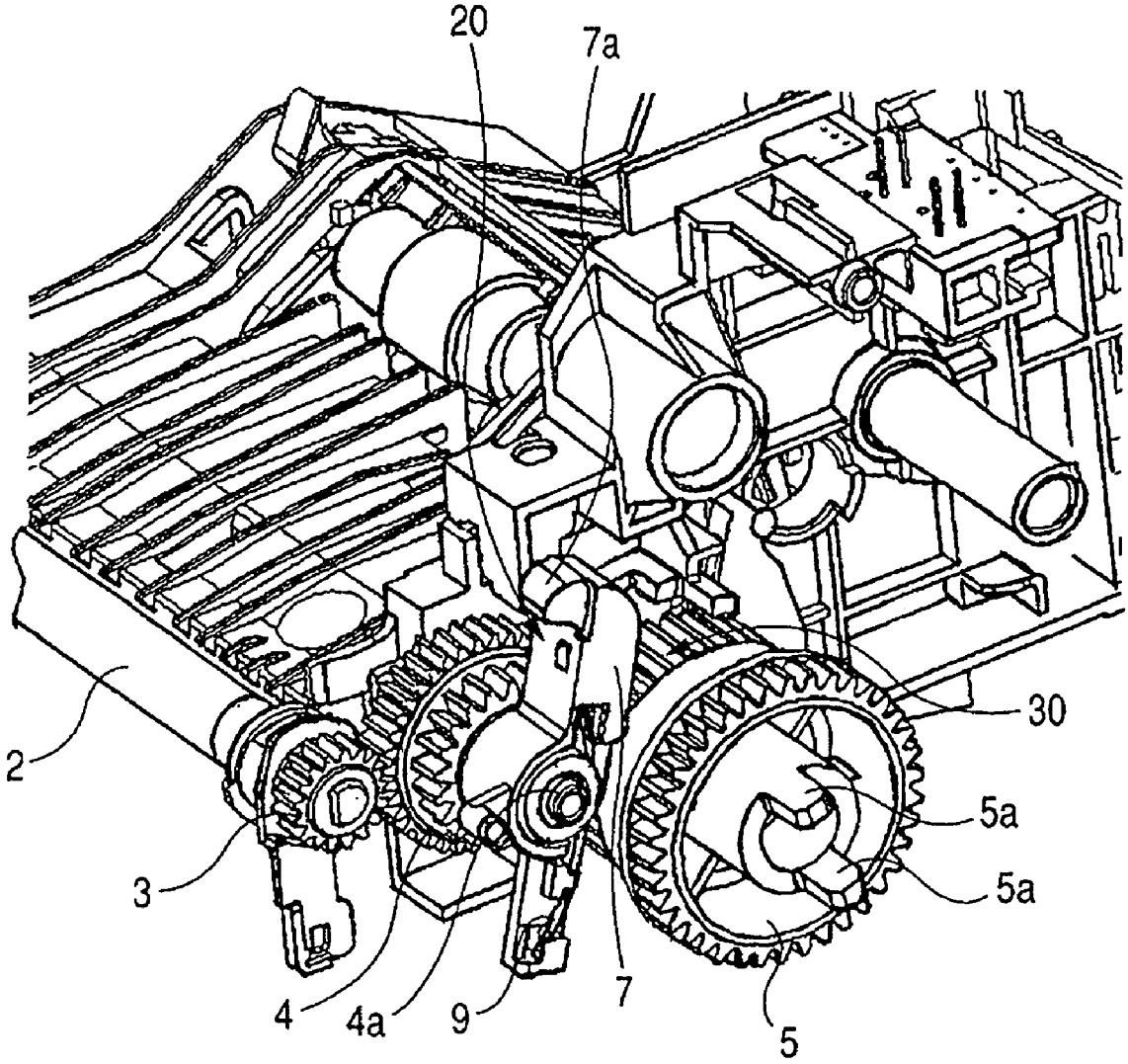
FIG. 12 is a partial perspective view of a drive transmission mechanism for driving an ink suction pump in the ink jet recording apparatus embodying the present invention.
Figure 13:
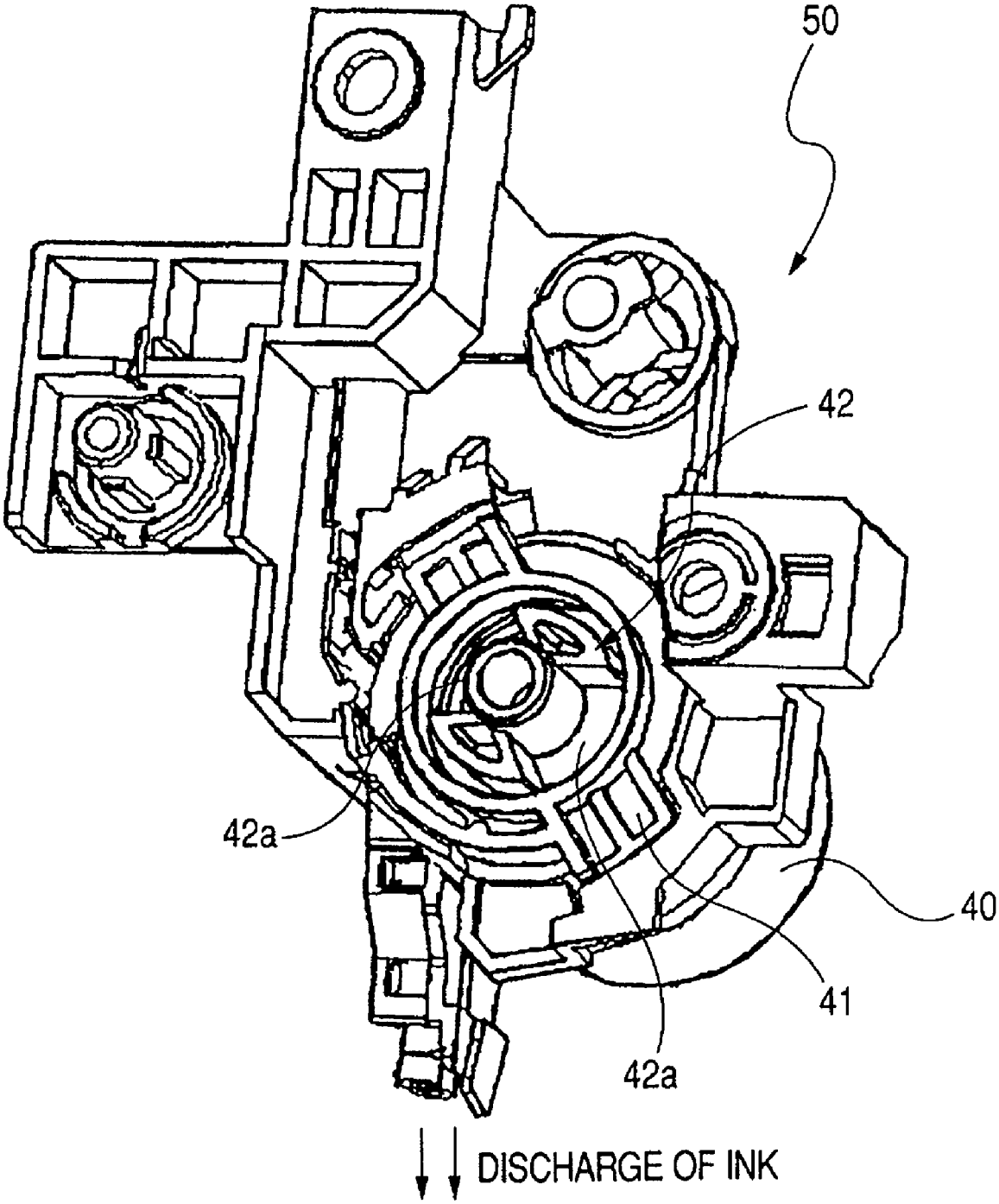
FIG. 13 is a perspective view of the pump shown in FIG. 6, seen from a connecting side with the drive transmission mechanism.
Figure 14:
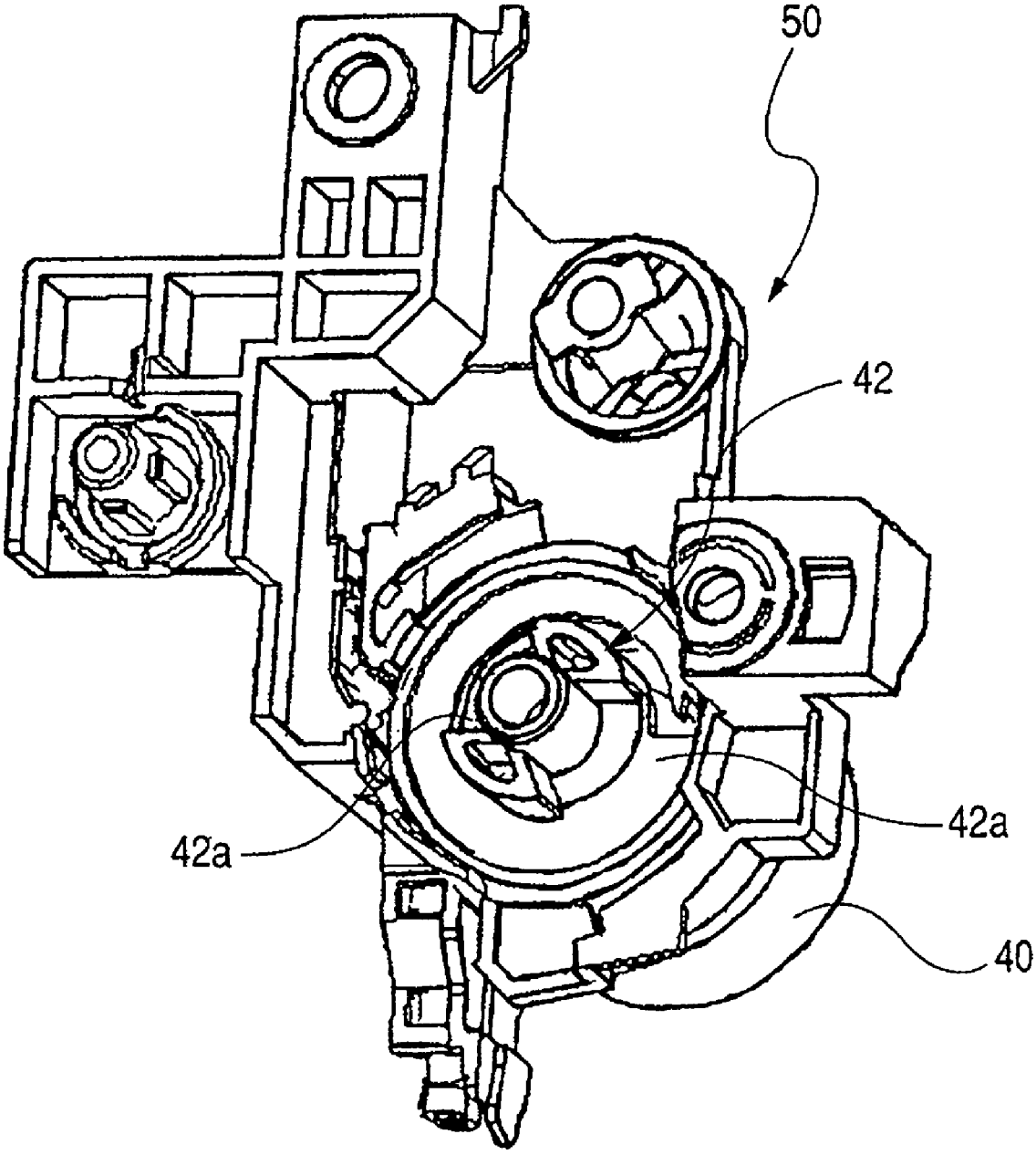
FIG. 14 is a perspective view of the pump in FIG. 13, shown without the holder stopper.
Figure 15:
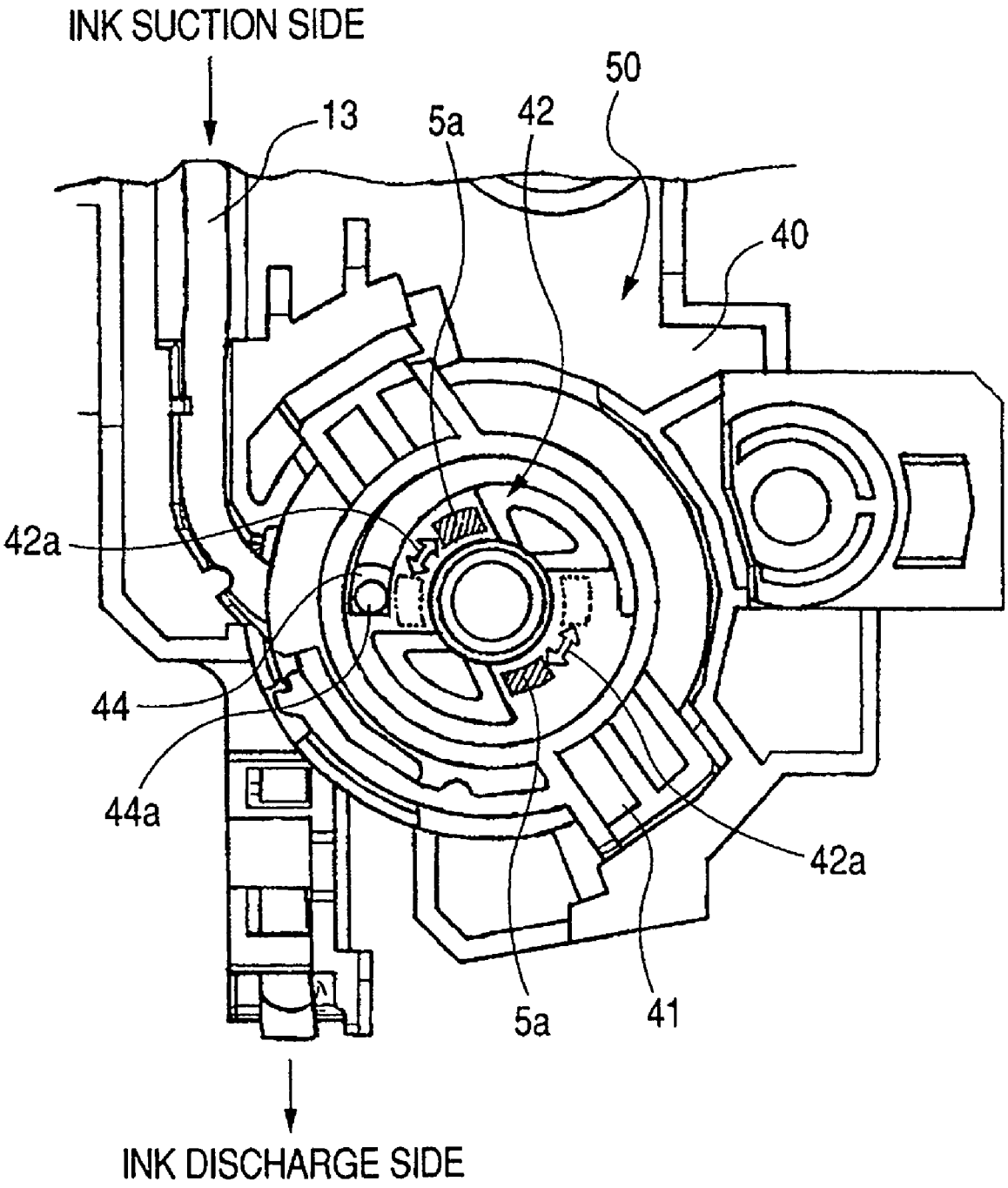
FIG. 15 is a partial elevation view of the pump in FIG. 13, showing a connecting part with the drive transmission mechanism.

FIG. 11 is a partial perspective view of a drive transmission mechanism for driving the ink suction pump 50, shown together with the pump 50, in the ink jet recording apparatus embodying the present invention; FIG. 12 is a partial perspective view of a drive transmission mechanism 30 for driving the ink suction pump 50 in the ink jet recording apparatus embodying the present invention; FIG. 13 is a perspective view of the pump shown in FIG. 7, seen from a connecting side with the drive transmission mechanism 30; FIG. 14 is a perspective view of the pump in FIG. 13, shown without the holder stopper; and FIG. 15 is a partial elevation view of the pump in FIG. 13, showing a connecting part with the drive transmission mechanism.

Referring to FIGS. 11 and 12, a conveying roller 2 for conveying the recording material is provided, at an end thereof, with an output gear 3, which meshes with one of two toothed portions of an idler gear 4. The other toothed portion of the idler gear 4 meshes with one of two toothed portions of a drive gear 5. The drive gear 5 is provided with a pair of engaging projections 5*a*, 5*a* constituting a connecting portion with the pump 50. Referring to FIGS. 13 to 15, the roller holder 42 of the pump 50 is provided with engaging grooves 42*a*, 42*a*, which respectively engage with the engaging projections 5*a*, 5*a* of the drive gear of the drive transmission mechanism 30, with a certain play (gap or looseness) in the rotational direction.

Thus, by inserting the engaging projections 5*a*, 5*a* engageably into the engaging grooves 42*a*, 42*a*, the drive gear 5 of the drive transmission mechanism is connected to the driving portion of the pump 50 with a certain play in the rotational direction. Therefore, even in a state where the engaging projections are inserted in and connected with the engaging grooves, the engaging projection of the drive gear 5 can freely move between a position indicated by a solid line and a position indicated by a chain line. Therefore, within the range of such play, the driving motion is not transmitted in either direction, whereby the roller holders 42, 43 retain their rotational position. The roller holder 41 (FIGS. 13 and 15) is fixed at the front end face of the pump base 40, whereby the roller holders, rotatably supported inside the pump base, are fixed in the axial direction and prevented from being detached.

Referring to FIGS. 11 and 12, a gear train constituting the drive transmission mechanism 30 includes lock means 20 serving to fix the carriage 6 in the capping position. The lock means for locking the carriage is constituted of a lever member (lock lever) 7 rotatably supported on a shaft 4*a* of the idler gear 4. The lever member is so supported, by a friction spring 9, as not to rotate with an external torque less than a predetermined value. The friction spring 9 is hooked, on both ends thereof, on spring hooks of the lever member, and is pressed, at a central portion thereof, to the shaft 4*a* of the idler gear, whereby the idler gear 4 and the lever member 7 can rotate in synchronization by a frictional force.

In the drive transmission mechanism 30 explained above, when the conveying roller 2 is driven in a reverse direction, a lock portion 7*a* at the end of the lever member 7, frictionally supported by the idler gear 4, rotates to a side for engaging with the carriage 6 (active position). FIG. 4 shows a state (active state of the lock means 20) where the lock portion 7*a* is in a carriage locking position. In this state, a counterclockwise rotation, in FIGS. 9 and 10, is transmitted to the roller holder 42, whereby the pump 50 generates a negative pressure. In such negative pressure generating state, the rollers 44 are retained in the solid-lined position as indicated in FIGS. 9 and 10 and rotate counterclockwise (sucking direction) while stroking through the tubes thereby generating a negative pressure therein.

On the other hand, when the conveying roller 2 is driven in the forward direction, the lever member 7 frictionally supported by the idler gear 4 rotates to a non-active position (retracted side) not interfering with the carriage 6, thereby assuming a non-active state in which the carriage is released from the locking. FIG. 3 shows a state where the lock portion 7*a* of the lever member is in a retracted state (non-active state of the lock means 20). In this state, a clockwise drive, in FIGS. 9 and 10, is transmitted to the roller holder 42, whereby the pump 50 is opened to the atmosphere and relieved from the negative pressure. In this state, as shown in FIGS. 9 and 10, the rollers 44 are retained in the chain-lined position and move clockwise (release direction) without compressing the tubes, whereby the interior of the tubes is open to the atmosphere.

As explained above, a play is provided in the drive connecting part between the drive gear 5 and the roller holder 42. Therefore, when the conveying roller 2 is switched from a sufficiently forward rotating state to a reverse rotating state, the driving power is immediately transmitted to the lever member (lock lever) 7, but is transmitted to the pump with a certain delay in time. More specifically, the driving power is transmitted to the roller holders 42, 43 across the non-interfering range formed by the aforementioned play in the drive transmitting portion, so that the pump drive is initiated with a delay in time (a difference in timing) corresponding to the passing through the non-interfering range. Thus, the present embodiment is so constructed, at the switching of the driving direction of the conveying roller 2, as to provide a difference in the timing of drive transmission in such a manner that the driving power of the conveying roller is not transmitted to the pump 50 for a period necessary for active/non-active switching of the locking means 20.

The non-interfering range between the engaging groove 42*a* of the roller holder and the engaging projection 5*a* of the drive gear may be formed with a play (room) for sufficiently executing the switching of operation of the lock means (lever member 7). If the number of teeth of the drive gear 5 is greater than the number of teeth of the idler gear 4 on which the lever member 7 is mounted, the rotation amount (rotation angle) of the roller holder 42 as driven can be reduced, based on the reducing ratio of the gears, by the amount required for the operation of the lever member. Therefore, the amount of play in the engaging groove 42*a* may be determined in consideration of the rotation angle required for the lever member and of the reducing ratio of the gear train.

Figure 16:
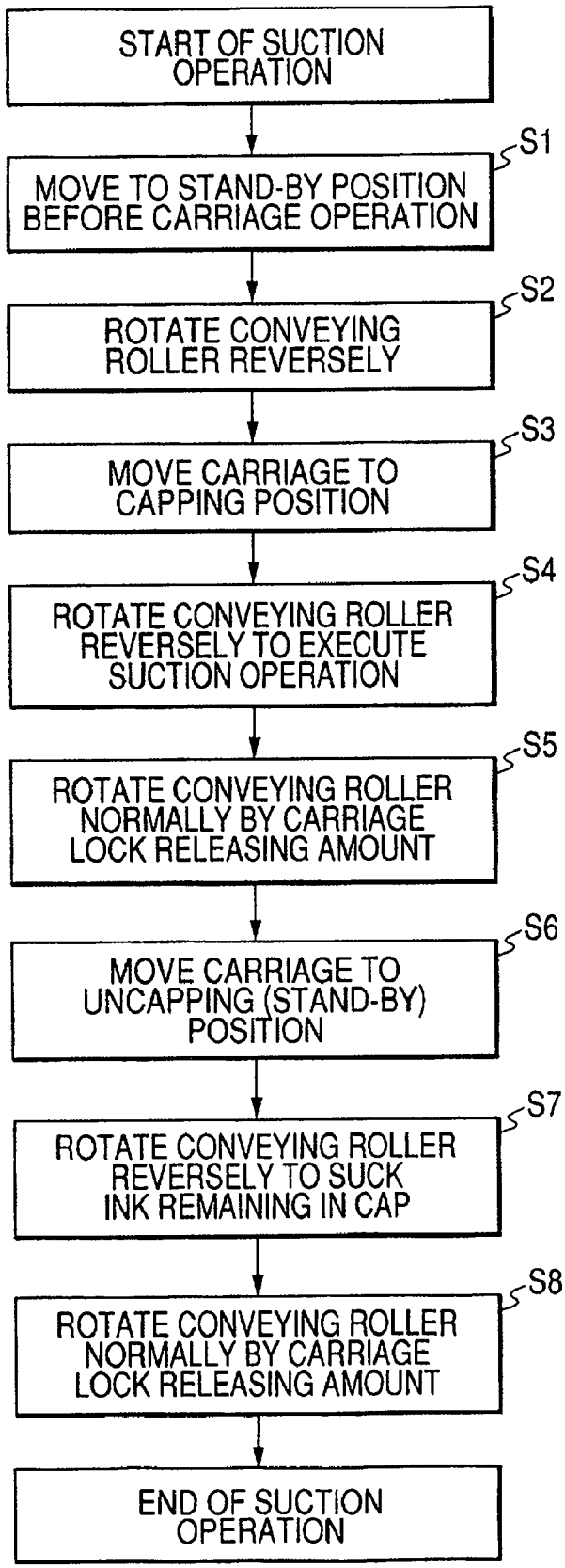
FIG. 16 is a flow chart showing a suction recovery operation of the recovery mechanism, together with a carriage locking operation, in the ink jet recording apparatus embodying the present invention.
Figure 17:
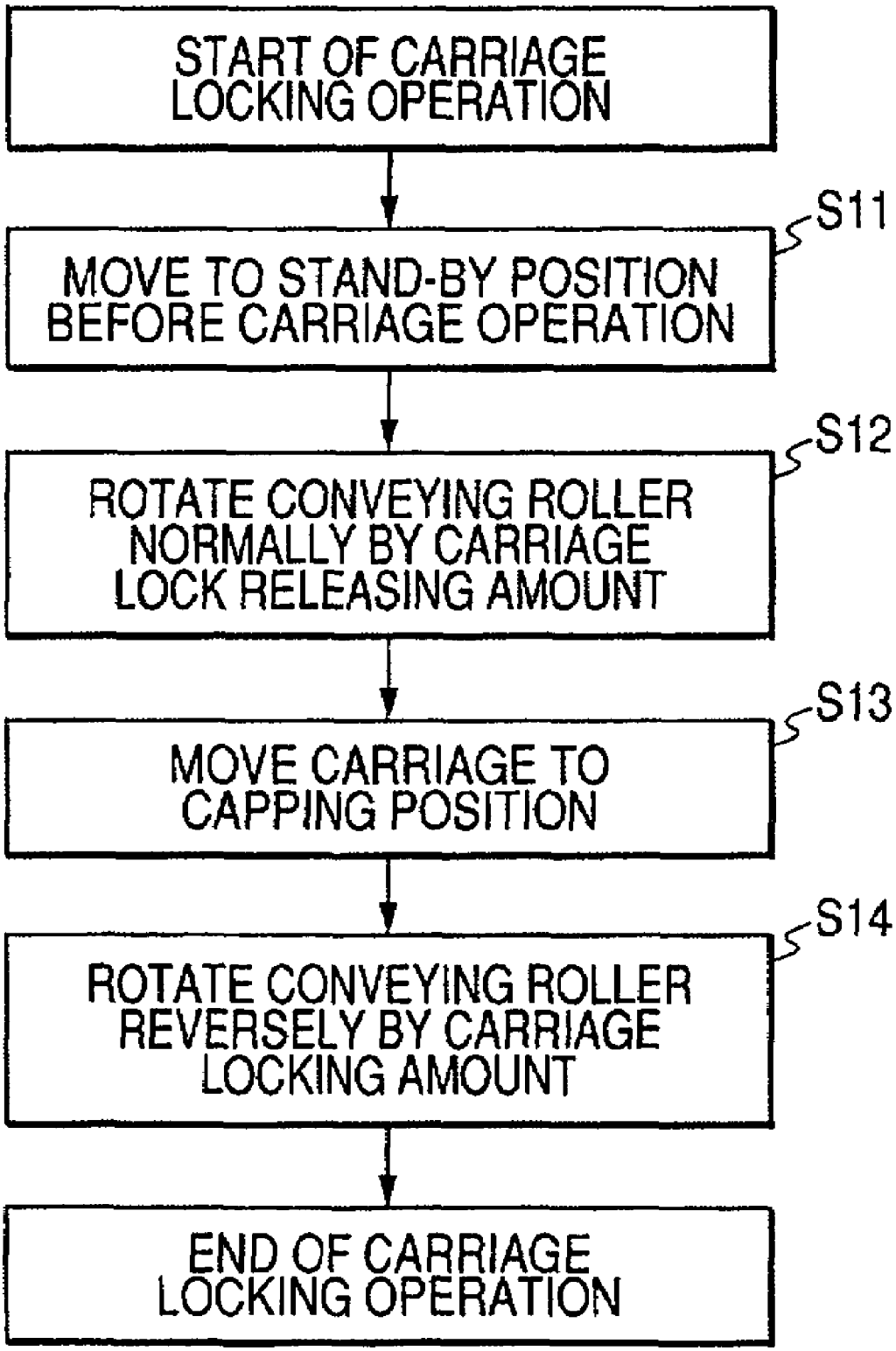
FIG. 17 is a flow chart showing a carriage locking operation, in the ink jet recording apparatus embodying the present invention.

FIG. 16 is a flow chart showing a suction recovery operation of the recovery mechanism, together with a carriage locking operation, in the ink jet recording apparatus embodying the present invention; and FIG. 17 is a flow chart showing a carriage locking operation, in the ink jet recording apparatus embodying the present invention. Referring to FIGS. 16 and 17, for executing a suction recovery operation, at first the carriage 6 is moved to a stand-by position before the carriage operation, in the recovery mechanism 104 shown in FIG. 2 (step S1). Then the conveying roller 2 is rotated in the reverse direction to activate the pump 50, thereby driving the two rollers 44 to a position of completely compressing the tubes 13, 14 (charged position) (step S2). In this state, the lever member 7 of the lock means 20 is simultaneously moved to the on-side (locking side), but, since the carriage and the lever member mutually overlap in the carriage moving direction, the displacement of the carriage is not hindered by the lever member.

After the rollers 44 are charged by the above-mentioned reverse rotation of the conveying roller, the carriage 6 moves to the capping position (elevated position shown in FIG. 3) where the discharge port faces of the recording heads 8A, 8B come in contact with the caps 11, 12 (step S3). In the present embodiment, the charging operation mentioned above is executed by displacing the shafts 44*a* of the rollers along the sliding faces 42*c*, 43*c* to come in contact with the pressing faces 42*d*, 43*d* at the end. Such charging operation realizes a state where the suction can be started immediately. After the capped state is realized in the step S3, the conveying roller 2 is further driven in the reverse direction thereby driving the pump by an amount necessary for the cleaning operation (suction operation) (step S4).

Ink is sucked from the discharge ports by the negative pressure generated in the cap. Also the reverse rotation of the conveying roller 2 in this state moves the lever member 7 to the engaging position, whereby the lock means 20 enters an active state. The rollers 44 are set in the charged state before the suction operation as explained above, because the drive amount (displacement amount) required by the roller 44 for completion of charging includes fluctuation, and, if the suction operation is initiated from an incompletely charged state, the suction amount also fluctuates for each suction operation, whereby the ink suction amount required for cleaning the recording head 8 may not be attained.

After the ink suction (step S4), the caps 11, 12 are separated from the discharge port face for opening to the atmosphere. In this state, however, since the lever member 7 is in active position (engaging position) as shown in FIG. 4, the carriage 6 cannot be moved from the recovery mechanism 104 toward the recording area. Therefore, while the recording head 8 is maintained in the capped state, the conveying roller 2 is driven in the forward direction by a predetermined amount, thereby moving the lever member to the retracted position to enter the non-active state (step S5). Thus, utilizing the difference in timing of drive transmission, provided by the play in the rotational direction in the drive connecting portion between the drive gear 5 and the roller holder 42, the lever member 7 alone is shifted from the engaging position to the retracted position before the driving power is transmitted to the roller holder 42.

In such operation, as the rollers 44 are not shifted in position from the state immediately after the suction operation, the negative pressure in the cap is retained. In this state, by separating the carriage 6 from the recovery mechanism in a state where the lever member 7 is retracted (step S6), whereby the cap can be opened while maintaining the negative pressure therein. Therefore, the ink remaining on the discharge port face or in the cap, when the cap is opened after the ink suction, can be minimized utilizing such remaining negative pressure.

Then, in such state with a reduced remaining ink amount, there can be executed a necessary cleaning process such as an idle suction operation for sucking the ink remaining in the cap or in the pump and a wiping operation for the discharge port face with a wiper (step S7). In this state, the lever member is returned again to the locking position (active position) by a reverse rotation of the conveying roller. Finally, the conveying roller 2 is driven in the forward direction for releasing the carriage lock, thereby rotating the lever member 7 to the retracted position and returning it to the initial standby state (step S8).

Then, reference is made to FIG. 17 for explaining operations of activating the lever member 7 for locking the carriage 6 at the capped position. At first, the carriage 6 is moved to a stand-by position (standby position before the carriage operation) in the recovery mechanism 104 shown in FIG. 2 (step S11). In case of capping the recording head 8 after the recording operation, the conveying roller is driven in the forward direction by a drive amount for retracting the rollers 44 from the tubes 13, 14 (step S12), thereby opening the interior of the tubes and preventing the discharge ports from being subjected to a positive pressure at the capping operation.

The positive pressure prevention in this operation is to avoid air being pressed into the discharge ports by the positive pressure acting on the ink discharge portion, because this may result in an unstable ink discharge by a destruction of an ink meniscus in the discharge ports or by an air mixing into the discharge ports. Such positive pressure is generated, in case the capping of the recording head is executed while the rollers 44 are in the charged position, by an air enclosure in the cap at the capping operation and by a decrease in the space in the cap by an elastic deformation thereof.

Also in order to prevent, in case the carriage 6 enters the recovery mechanism 104 in another cleaning operation with the lever member 7 in the active state (engaging state), that the carriage becomes inoperable by interfering with the lever member, the locking portion 7*a* of the lever member is provided, on a lateral face at the recording area side, with a tapered face 7*b*. Thus, even if the carriage 6 enters the recovery mechanism side from the recording area side with the lock means 20 in the active state, the lever member (locking lever) can be automatically switched, utilizing the carriage displacement, to the non-active state (lock released state).

After the forward rotation of the conveying roller 2 in the step S12, the carriage 6 is moved to the capping position (step S13). Thereafter, the conveying roller 2 is driven in the reverse direction by a small amount which is not transmitted to the roller holder 42 but merely displaces the lever member 7 to the engaging position (step S14). Such carriage locking operation as explained above allows, even when the carriage is locked in the capping position, to stop the rollers 44 of the pump in a position not generating the negative pressure. It is thus made possible to achieve the necessary capping function and the necessary carriage locking function at the same time.

In the above-described embodiment, the activation/stopping of the pump 50 is executed with a delay of a predetermined time from the forward/reverse switching of rotation of the conveying roller 2, and the activation/deactivation of the lock means 20 is executed simultaneous with the forward/reverse switching of rotation of the conveying roller 2. Therefore, when the conveying roller is driven for a time necessary for the activation/deactivation switching of the lock means at the switching of the driving direction of the conveying roller, a difference in timing can be realized in the drive transmission so as not to transmit the driving power to the pump. Such constitution allows, even when a carriage locking mechanism is provided, to separate the cap from the recording head while retaining the negative pressure in the cap after the ink suction operation, thereby reducing the ink amount remaining on the discharge port face or in the cap after the ink suction operation. It is thus rendered possible to secure the recording quality and to reduce the ink overflowing into the apparatus.

The foregoing embodiment has been explained by an example of capping two recording heads with two caps, but the present invention is applicable widely regardless of the number of the recording heads or the caps, with similar effects. Also the present invention is similarly applicable to any ink jet recording apparatus for executing a recording operation by discharging ink from a recording head, regardless of the operating type of the recording head such as a recording head utilizing an electrothermal converting member such as a heat generating element or a recording head utilizing an electromechanical converting member such as a piezoelectric element, with similar functions and effects.

Embodiments of the present invention allow, when a carriage locking mechanism is provided, to separate the cap from the recording head while retaining the negative pressure in the cap after the ink suction operation, thereby reducing the ink amount remaining on the discharge port face or in the cap after the ink suction operation. Thus, there can be provided an ink jet recording apparatus capable of securing the recording quality and reducing the ink overflow into the apparatus.

This application claims priority from Japanese Patent Application No. 2005-139418 filed May 12, 2005, which is hereby incorporated by reference herein.

What is claimed is:

1. An ink jet recording apparatus, comprising:

a carriage for mounting therein a recording head which executes a recording operation by discharging ink onto a recording material, the carriage being movable in a predetermined direction within a range including a recording area;

a conveying roller for conveying a recording material in a direction crossing the predetermined direction;

a cap, provided outside the recording area in the predetermined direction, for covering a discharge port of the recording head;

a pump for generating a negative pressure in an interior of the cap;

a lock member for locking movement of the carriage at a predetermined position in the predetermined direction, the lock member being movable between a lock position and an unlock position; and a drive transmission mechanism for transmitting a driving power of the conveying roller to the pump for generating the negative pressure and to the lock member for moving between the lock position and the unlock position, wherein the drive transmitting mechanism includes a delay mechanism to delay transmission of the driving power to the pump as compared with transmission of the driving power to the lock member, wherein when the lock member is in the lock position, the lock member can be switched to the unlock position by being urged by the carriage moving from the recording area toward a capping position.

2. An ink jet recording apparatus according to claim 1, wherein the lock member locks the carriage at a capping position as the predetermined position where the cap can cover the discharge port.

3. An ink jet recording apparatus according to claim 1, wherein the cap is mounted on a slider which is movable following a movement of the carriage within a predetermined range outside the recording area.

4. An ink jet recording apparatus according to claim 1, wherein the drive transmission mechanism includes a gear train.

5. An ink jet recording apparatus according to claim 4, wherein the delay mechanism comprises a connecting part located between the gear train and the pump, with the connecting part including play for delaying the transmission of the driving power.

6. An ink jet recording apparatus according to claim 1, wherein the lock member is a lever member.

7. An ink jet recording apparatus according to claim 1, wherein, after a suction operation of sucking ink from the discharge port of the recording head by driving the pump in a capped state of the recording head, the lock member is switched from the lock state to the unlock state to move the carriage while maintaining a negative pressure in the cap, thereby separating the recording head from the cap.

8. An ink jet recording apparatus according to claim 1, wherein, in locking the carriage at the capping position by the lock member, the carriage is locked while the interior of the cap is maintained in a state open to the atmosphere.

9. An ink jet recording apparatus according to claim 8, wherein, before locking the carriage at the capping position, the conveying roller is driven in the forward direction by a predetermined amount, thereby opening the interior of the cap to the atmosphere.

10. An ink jet recording apparatus according to claim 1, wherein the lock member has a tapered face capable of contacting with a part of the carriage while the lock member is in the lock position, and the lock member rotates to be in the unlock position when the carriage has passed through the lock member to the capping position.

11. An ink jet recording apparatus, comprising:

a carriage for mounting therein a recording head which executes a recording operation in a recording area by discharging ink onto a recording material;

a conveying roller for conveying the recording material in a direction which crosses a moving direction of the carriage;

a cap for covering a discharge port of the recording head;

a pump for generating a suction force in an interior of the cap;

a drive transmission mechanism for transmitting a driving power of the conveying roller to the pump, wherein the pump is driven with a delay of a predetermined time from a forward/reverse switching of the conveying roller; and a lock member which locks the carriage at a capping position where the discharge port is covered with the cap, wherein the lock member moves simultaneously with the forward/reverse switching of the conveying roller, and when the lock member is in a lock position, the lock member can be switched to an unlock position by movement of the carriage toward the cap from the recording area.

* * * * *